United States Patent [19]

Gerzon

[11] 3,997,725

[45] Dec. 14, 1976

[54] MULTIDIRECTIONAL SOUND REPRODUCTION SYSTEMS

[75] Inventor: Michael Anthony Gerzon, Oxford, England

[73] Assignee: National Research Development Corporation, London, England

[22] Filed: Mar. 21, 1975

[21] Appl. No.: 560,865

[30] Foreign Application Priority Data

Mar. 26, 1974 United Kingdom ..... 13292/74

[52] U.S. Cl. ..... 179/1 GQ; 179/100.4 ST; 179/100.1 TD

[51] Int. Cl.[2] ..... H04R 5/00

[58] Field of Search ..... 179/1 GQ, 1 G, 15 BT, 179/100.4 ST, 100.1 TD

[56] References Cited

UNITED STATES PATENTS

| | | | |
|---|---|---|---|
| 3,784,746 | 1/1974 | Hess | 179/1 GQ |
| 3,830,978 | 8/1974 | Odagi | 179/1 GQ |
| 3,856,992 | 12/1974 | Cooper | 179/100.4 ST |
| 3,883,692 | 5/1975 | Tsurushima | 179/1 GQ |
| 3,885,101 | 5/1975 | Ito et al. | 179/100.4 ST |
| 3,887,770 | 6/1975 | Takahashi | 179/1 GQ |
| 3,892,918 | 7/1975 | Takahashi et al. | 179/100.4 ST |

*Primary Examiner*—Douglas W. Olms
*Attorney, Agent, or Firm*—Cushman, Darby & Cushman

[57] ABSTRACT

In a sound reproduction system of the type which enables the listener to distinguish sound from sources extending over 360° of azimuth, compensation is provided for the asymmetry arising when four loudspeakers are located at the corners of a non-square rectangle. Compensation is also provided for the different localization mechanisms used by a human listener at high and low frequencies. The invention is also applicable to systems which enable the listener to distinguish sounds from different heights.

13 Claims, 13 Drawing Figures

MULTIDIRECTIONAL SOUND REPRODUCTION SYSTEMS

Figure 1:
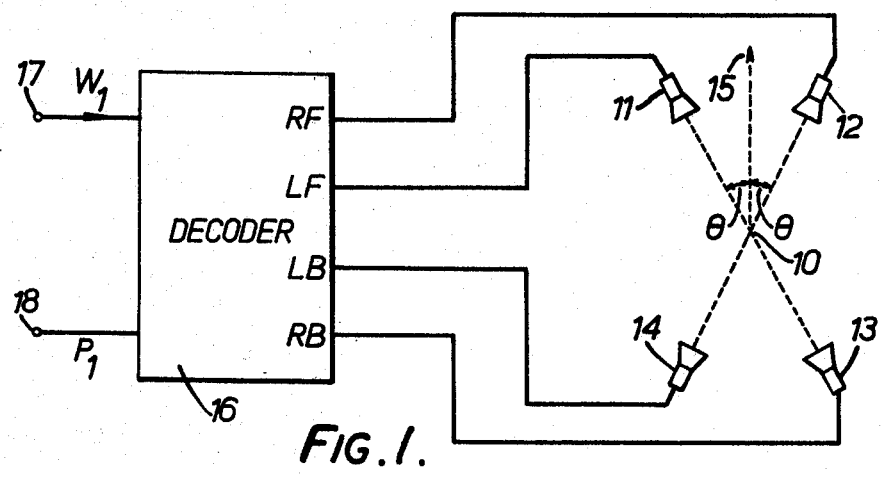

This invention relates to sound reproduction systems and more particularly to sound reproduction systems which enable the listener to distinguish sound from sources extending over 360° of azimuth. Certain aspects of the invention are concerned with the provision of a sound reproduction system of this type which in addition enables the listener to distinguish sounds from sources at different heights.

U.S. application Ser. No. 430519 discloses a sound reproduction system which enables the listener to hear sound from sources extending over 360° of azimuth and which employs only two independent transmission channels. In the system described in this specification, one channel carries so-caled omnidirectional signal components which contain sound from all horizontal directions with equal gain. The other channel carries so-called azimuth or phasor signal components containing sounds with unity gain from all horizontal directions but with a phase shift relative to the corresponding omni-directional signal component which is related to, and is preferably equal to, the azimuth angle of arrival measured from a suitable reference direction. The phasor signal may be resolved into two components with a phase difference of 90°. When these signal components are applied to four loudspeakers located at the corners of a square, one signal component constitutes a difference signal indicating the difference in signal strength between the signals for a first adjacent pair of loudspeakers and the signals for a second adjacent pair comprising the other two loudspeakers. The other component constitutes a second difference signal indicative of the difference in signal strength between the signals for a third adjacent pair of loudspeakers comprising one loudspeaker from each of the first and second adjacent pairs and the signals for a fourth adjacent pair comprising the other loudspeakers from each of the first and second adjacent pairs.

One object of the present invention is to improve the results obtained with a four loudspeaker array when the four loudspeakers are not symmetrically disposed with respect to the centre of a listening area.

According to the invention in one aspect, there is provided a decoder for a second reproduction system having four loudspeakers surrounding a listening area and located at the corners of a non-square rectangle, said decoder comprising input means for receiving at least two input signals comprising omni-directional and phasor signal components and output means for producing a respective output signal for each loudspeaker, said output signals including first difference signal components indicating the difference in signal strength between the sum of the signals for a first adjacent pair of said loudspeakers and the sum of the signals for a second adjacent pair comprising the other two loudspeakers and second difference signal components indicative of the difference in signal strength between the sum of the signals for a third adjacent pair of loudspeakers comprising one loudspeaker from each said first and second adjacent pairs, and the sum of the signals for a fourth adjacent pair of loudspeakers comprising the other loudspeaker from each of said first and second adjacent pairs of loudspeakers, and layout control means for applying a first gain to said first difference signal component and a second gain to said second difference signal component, the ratio between the first and second gains being substantially equal to the ratio between the sine of half the angle subtended by the first pair of loudspeakers and the sine of half the angle subtended by the third pair of loudspeakers at the centre of the listening area.

In some embodiments of the invention, the first and second signal components may exist as separate signals, the means for receiving the input signals being arranged to produce an omni-directional signal and two difference signals for supply to the means for producing the respective output signals for the loudspeakers. When the invention is applied to the system described in the above-mentioned specification, the difference signal components are combined in the phasor signal and the relative variation of gains between them is achieved by varying the relative phase shift between the omni-directional and phasor signal components for each loudspeaker so that they exceed the amount of the phase difference for a corresponding loudspeaker in a square array by the same amount as the angular position of such loudspeaker relative to a reference direction is less than that of the corresponding loudspeaker in a square array and vice versa.

The invention is also applicable to other decoders in which the first and second difference signal components do not exist as discrete signals and further to systems in which the layout control means is operative on signals where the difference signal components do not exist as discrete signals even though such discrete signals are available elsewhere in the decoder.

The invention may further provide a decoder for a sound reproduction system having eight loudspeakers located at the corners of the non-cubic cuboid, said decoder comprising means for receiving at least three input signals and means responsive to said input signals for producing a respective output signal for each loudspeaker, said output signals including first difference signal components indicative of the difference in signal strength between the sum of the signals for the four loudspeakers at the corners of a first face of the cuboid and the sum of the signals for the four loudspeakers at the face of the cuboid opposite said first face, second difference signal components indicating the difference in signal strength between the sum of the signals for the four loudspeakers at the corners of a second face of the cuboid perpendicular to said first face and the sum of the signals for the four loudspeakers at the corners of the face of the cuboid opposite said second face and third difference signals indicating the difference in signal strength between the sum of the signals for the loudspeakers at the corners of a third face of the cuboid perpendicular both to said first and to said second face and the sum of the signals for the four loudspeakers at the face of the cuboid opposite said third face, and layout control means for applying a first gain to said first difference signal component, a second gain to said second signal component and a third gain to said third signal component, the ratio between the first, second and third gains being inversely proportional to the ratio between the distances separating said first, second and third faces of the cuboid from their respective opposite faces.

According to the invention, in another aspect, there is provided a decoder for a sound reproduction system comprising output means for providing output signals for at least three loudspeakers surrounding a listening position, input means for receiving at least two input signals comprising pressure signal components representative of the sum of the desired output signals and velocity signal components representative of the desired velocity of the sound field at said listening position and gain adjustment means between the input means and the output means and arranged to apply frequency dependent relative gains to said pressure and velocity signal components such that the gain applied to pressure signal components of frequencies substantially above a predetermined frequency divided by the gain applied to velocity signal components of frequency substantially above said predetermined frequency is greater than the gain applied to pressure signal components of frequency substantially below said predetermined frequency divided by the gain applied to velocity signal components of frequencies substantially below said predetermined frequency.

The pressure and velocity signals may be omnidirectional and phasor signals respectively.

For four-loudspeaker rectangular arrangements, the velocity signal preferably has a gain of about twice that of the pressure signal for frequencies substantially below said predetermined frequency band.

The need for different treatment for frequencies above and below a particular frequency band is fully discussed in M. A. Gerzon "Criteres Psychoacoustiques Relatifs a la Realisation des Systemes Matriciels et Discrets en Tetraphonie" published in the 1974 Paris International Festival du Son "Journees d'Etudes", Editions Radio, Paris and in M. A. Gerzon "Surround-sound psychoacoustics" Wireless World, December, 1974 pages 483 to 486. Briefly, for frequencies appreciably less than the frequency for which the distance between the human ears is less than half a wavelength of sound in air, (about 700 Hz) the head offers no obstacle to sound waves so that the amplitude of sound reaching the two ears is virtually identical. Consequently, the only information available at these low frequencies for sound localisation is the phase difference between the sounds received at the two ears. At higher frequencies, the phase relationship is no longer of primary importance in sound localisation; what matters is the directional behaviour of the energy field around the listener. There is a transitional band, referred to above as the predetermined frequency band, between these two conditions.

The transitional frequency may be within the range 100 Hz to 1000 Hz. Transitional frequencies at the lower end of the range give an increased listening area. A preferred value is about 320 Hz.

Figure 2:
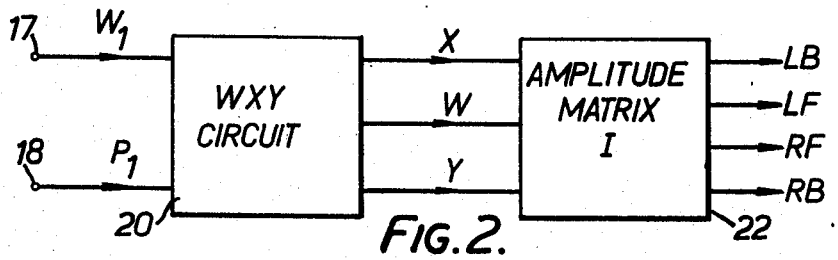
Figure 3:
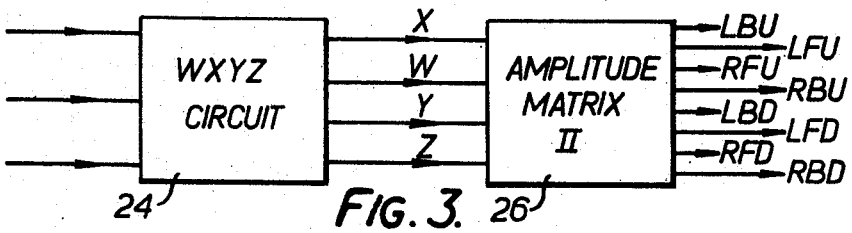
Figure 4:
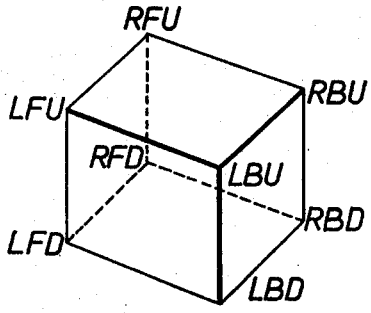
Figure 5:
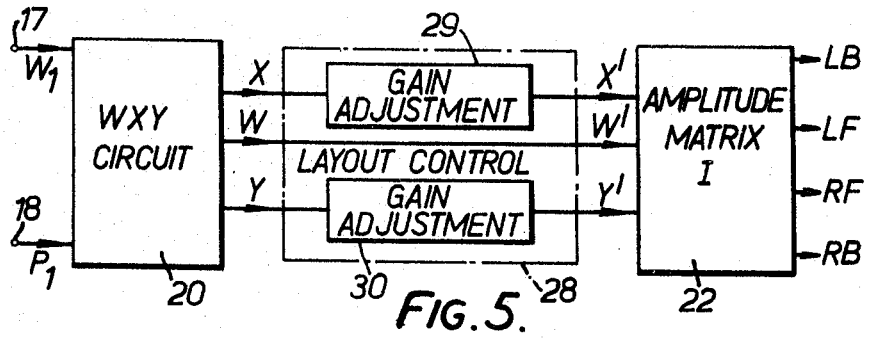
Figure 6:
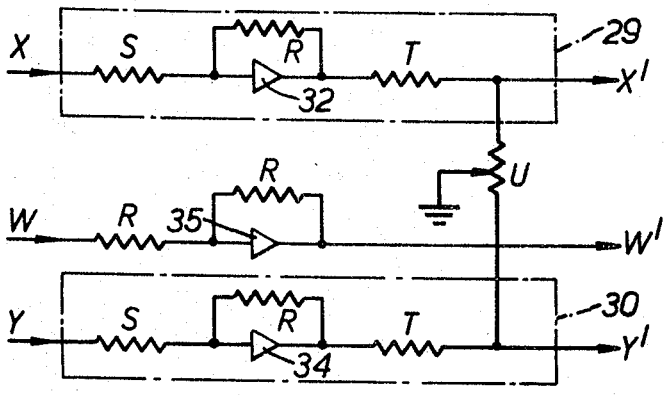
Figure 7:
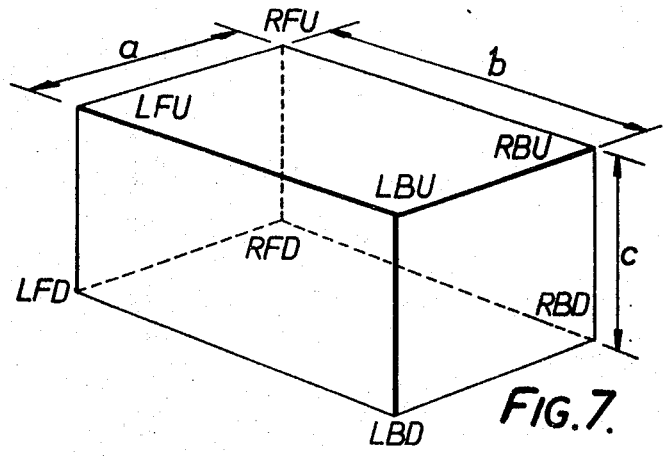
Figure 8:
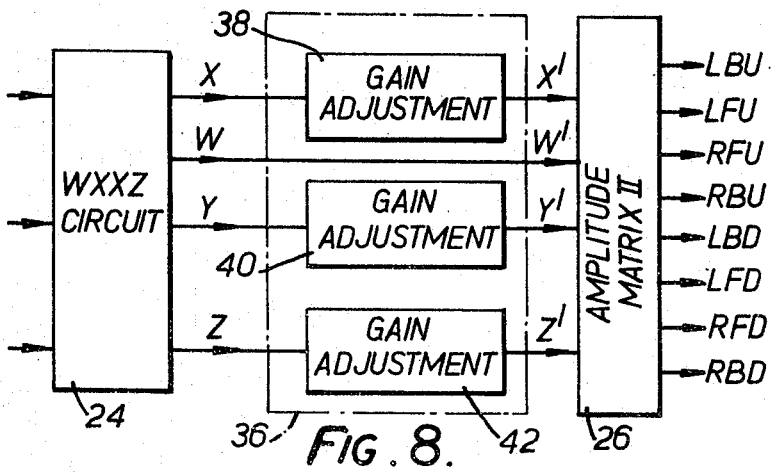
Figure 9:
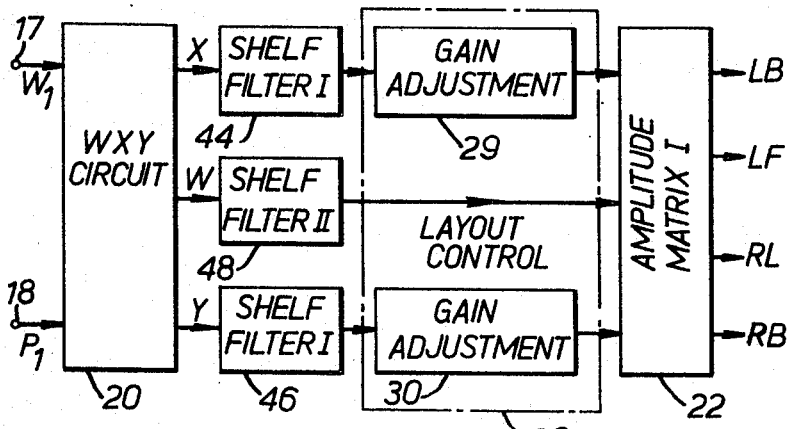
Figure 10:
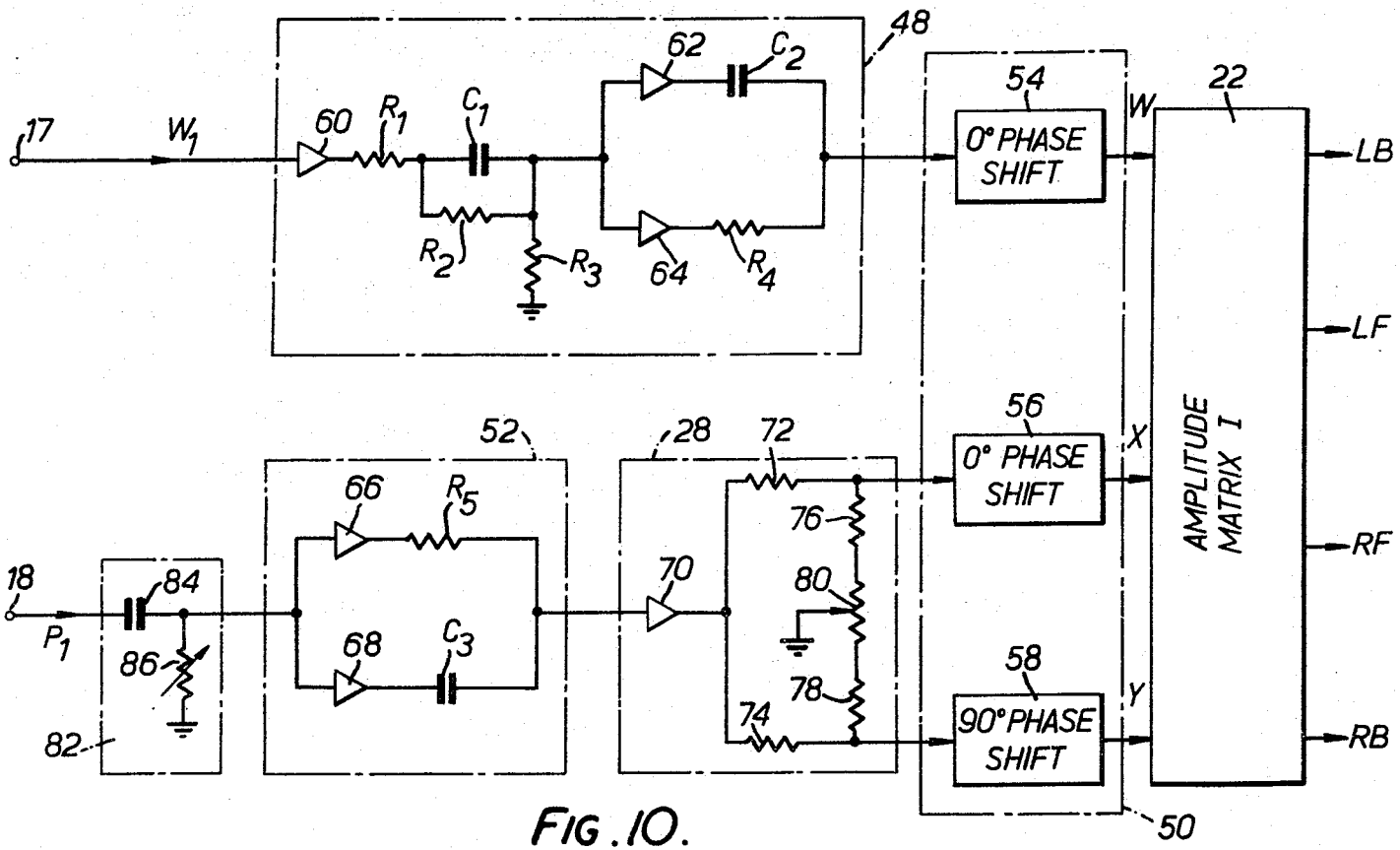
Figure 11:
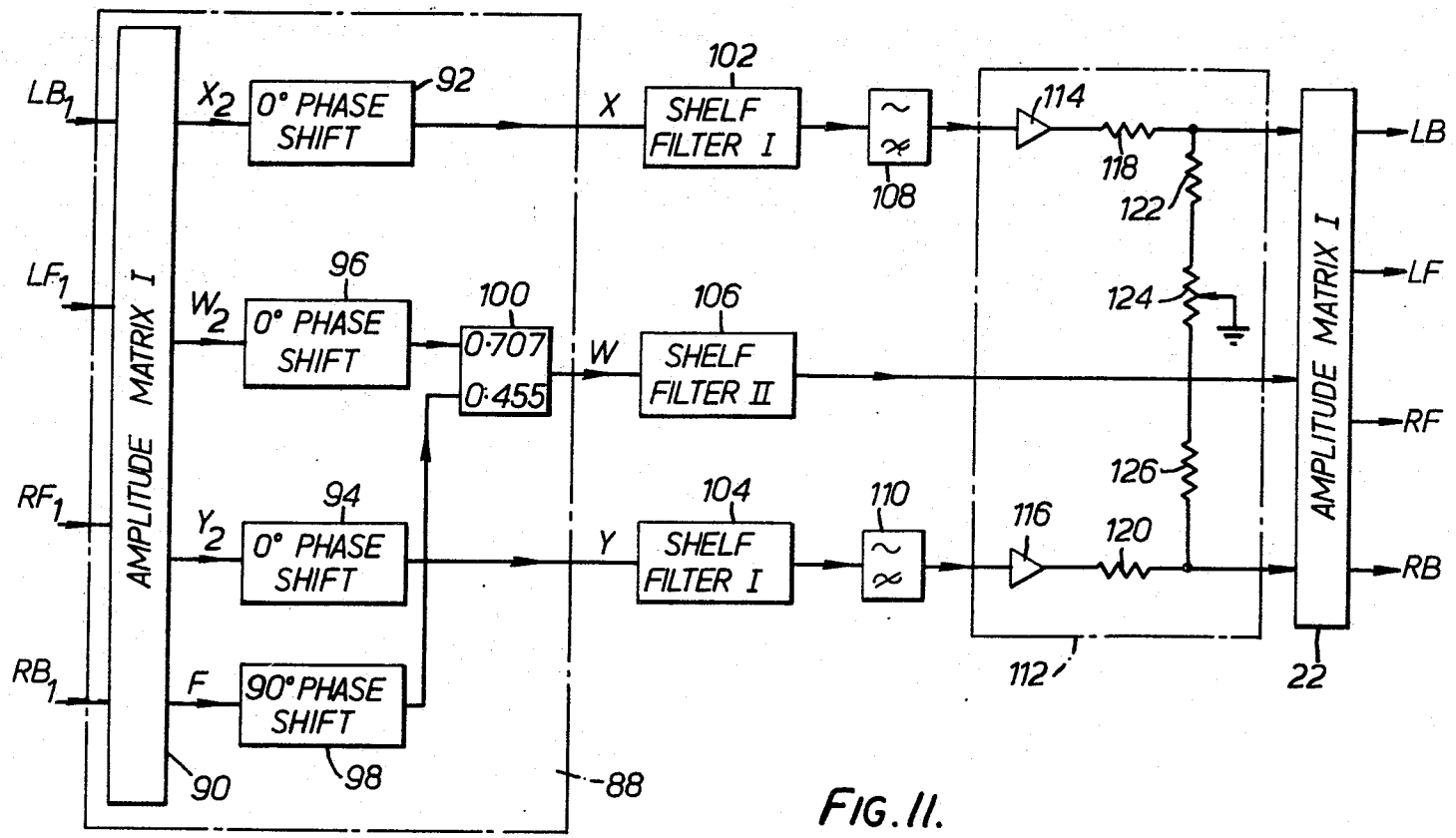
Figure 12:
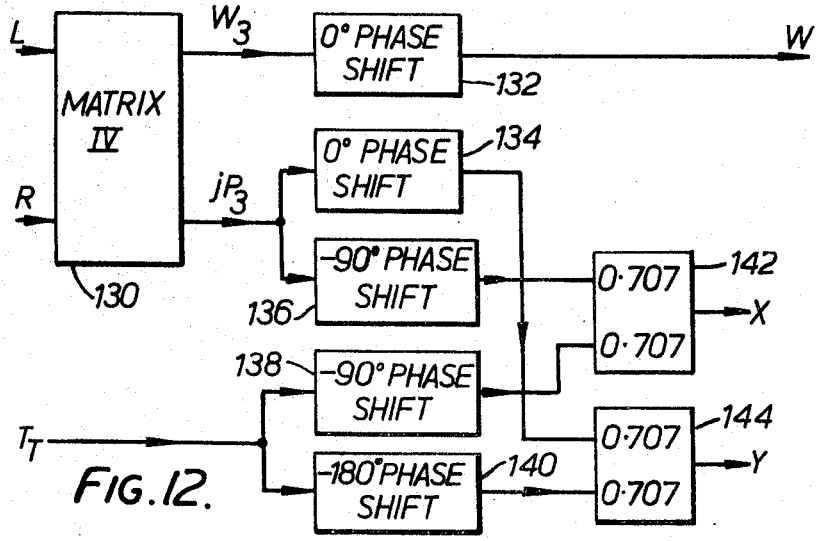
Figure 13:
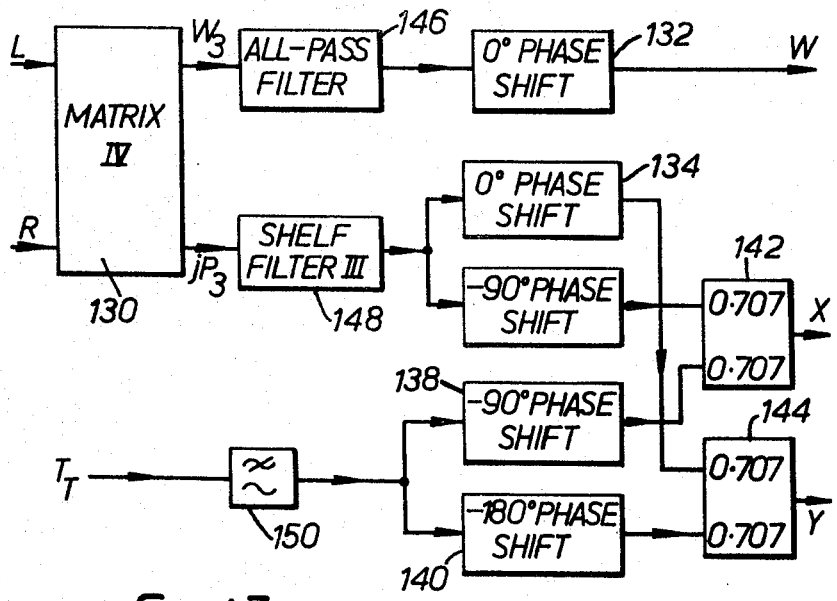

Embodiments of the invention will now be described by way of example with reference to the accompanying drawings, in which:

FIG. 1 is a schematic diagram of a sound reproduction system illustrating the disposition of the loudspeakers round a listening position and their connection to a decoder, FIG. 2 is a block diagram of a known decoder suitable for use in the system shown in FIG. 1, FIG. 3 is a block diagram of a decoder for use in a sound reproduction system providing height information and employing eight loudspeakers, FIG. 4 is a schematic diagram illustrating the disposition of loudspeakers for use with the decoder shown in FIG. 3, FIG. 5 shows a decoder in accordance with the invention including a layout control unit, FIG. 6 is a circuit diagram of a layout control unit for use in the decoder shown in FIG. 5, FIG. 7 is a schematic diagram, similar to FIG. 4, illustrating the layout of an eight loudspeaker cuboid array, FIG. 8 is a schematic diagram of a decoder in accordance with the invention for use with the loudspeaker array shown in FIG. 7, FIG. 9 is a block diagram of a frequency dependent decoder in accordance with the invention, FIG. 10 is a circuit diagram of a decoder of the type shown in FIG. 9, FIG. 11 is a block diagram illustrating a decoder in accordance with the invention for use with discrete four channel signals, FIG. 12 is a block diagram of an alternative WXY circuit for use with the decoder of FIG. 11, and FIG. 13 is a further alternative WXY circuit for use with the decoder of FIG. 11.

It should be understood that, in the following description, where reference is made to a set of phase shifting circuits applying different phase shifts to different parallel channels, the phase shift specified in each case is a relative phase shift and a uniform additional phase shift may be applied to all channels if desired. Similarly, where it is specified that particular gains are applied to parallel channels, these gains are relative gains and a common additional overall gain may be applied to all channels if desired.

Before describing embodiments of the invention, it will be convenient to describe the basic form of a type of a decoder suitable for use with rectangular loudspeaker layouts and the corresponding type for use with cuboid loudspeaker layouts. These two types of decoder are hereinafter referred to as WXY decoders and WXYZ decoders respectively. The invention may be applied to any decoder of these types.

Referring to FIG. 1, a listening location centred on the point 10 is surrounded by four loudspeakers 11, 12, 13 and 14 which are arranged in a rectagular array. The loudspeakers 11 and 12 each subtend an equal angle $\theta$ at the point 10 relative to a reference direction indicated by an arrow 15. A loudspeaker 13 is disposed opposite the loudspeaker 11 and the loudspeaker 14 disposed opposite the loudspeaker 12. Thus, assuming that the reference direction is the forward direction, the loudspeaker 11 is disposed at the left front position, loudspeaker 12 at the right front position, the loudspeaker 13 at the right back position and the loudspeaker 14 at the left back position. All four loudspeakers 11 to 14 are connected to receive respective output signals LF, RF, RB and LB from the decoder 16 which has two input terminals 17 and 18, the received omnidirectional signal $W_1$ being connected to the terminal 17 and the phasor signal $P_1$ to the terminal 18.

FIG. 2 shows a known WXY decoder suitable for use as the decoder 16 when the angle $\theta = 45°$. The decoder takes the form of a WXY circuit 20 and an amplitude matrix 22. The WXY circuit 20 produces an omnidirectional output signal W, a front-back difference output signal X and a left-right difference output signal Y. These signals are then applied to the amplitude matrix 22 which produces the required output signal LB, LF, RF and RB.

The nature of the WXY circuit depends on the form of the input signals. If, as shown, the input signals comprise an omni-directonal signal $W_1$ and a phasor signal $P_1$ of the same magnitude as the omni-directonal signal but with a phase difference equal to minus the azimuth angle, the outputs of the WXY circuit 20 are related to its inputs as follows:

$$W = W_1$$

$$X = \tfrac{1}{2} P_1$$

$$Y = \tfrac{1}{2} jP_1$$

The amplitude matrix 22 fulfills the function of the following group of equations:

$$LB = \tfrac{1}{2}(-X + W + Y)$$

$$LF = \tfrac{1}{2}(X + W + Y)$$

$$RF = \tfrac{1}{2}(X + W - Y)$$

$$RB = \tfrac{1}{2}(-X + W - Y)$$

In fact this decoder is the same as the decoder shown in FIG. 5 of the above-mentioned U.S. application Ser. No. 430519, the 90° phase shift circuits serving as the active part of the WXY circuit 20 and the adders and phase inverters serving as the amplitude matrix 22.

Any decoder which produces the four output signals LB, LF, RF and RB is the equivalent of a WXY circuit and an amplitude matrix, and thus constitutes a WXY decoder, provided that $$\tfrac{1}{2}(-LB + LF - RF + RB) = 0$$

The WXY circuit 20 may have more than two inputs.

A WXYZ decoder may be used in systems providing height information and employing eight loudspeakers disposed at respective corners of a cube. Referring to FIG. 3, three input signals are applied to a WXYZ circuit 24 which produces output signals W, X and Y having the same significance as the corresponding signals of FIG. 2 and an up-down difference signal Z. The signals W, X, Y and Z are applied to a type II amplitude matrix 26 which produces eight loudspeaker signals LBU, LFU, RFU, RBU, LBD, LFD, RFD and RBD, the signals being fed to loudspeakers located at the correspondingly referenced points in FIG. 4. The construction of the WXYZ circuit 24 depends on the nature of the input signals. The output signals from the type II matrix 26 are related to the input signals as follows:

$$LBU = \tfrac{1}{2}(-X + W + Y + Z)$$

$$LFU = \tfrac{1}{2}(X + W + Y + Z)$$

$$RFU = \tfrac{1}{2}(X + W - Y + Z)$$

$$RBU = \tfrac{1}{2}(-X + W - Y + Z)$$

$$LBD = \tfrac{1}{2}(-X + W + Y - Z)$$

$$LFD = \tfrac{1}{2}(X + W + Y - Z)$$

$$RFD = \tfrac{1}{2}(X + X - Y - Z)$$

$$RBD = \tfrac{1}{2}(-X + W - Y - Z)$$

As for the two-dimensional case, any decoder is the equivalent of a WXYZ circuit and an amplitude matrix, and thus constitute a WXYZ decoder, if the following equations are satisfied:

$$(LBU+LBD) - (LFU+LFD) + (RFU+RFD) - (RBU+RBD) = 0$$

$$(LBD+RBD) - (LFD+RFD) + (LFU+RFU) - (LBU+RBU) = 0$$

$$(LBD+LFD) - (LBU+LFU) + (RBU+RFU) - (RBD+RFD) = 0$$

$$(LBU-LBD) - (LFU-LFD) + (RFU-RFD) - (RBU-RBD) = 0$$

Reverting to the loudspeaker arrangement and WXY decoder shown in FIGS. 1 and 2, in accordance with the invention, a layout control unit is provided to adjust the gains of the X and Y signals relative to the W signal to compensate for the non-square layout obtained when $\theta \neq 45°$. For example, when $\theta < 45°$ the gain for the front minus back signal has to be reduced for the increased front-back separation of loudspeakers and similarly, the gain of the left minus right signal Y has to be increased to compensate for the decreased side to side loudspeaker separation.

Referring to FIG. 5, a layout control unit 28 is connected between the WXY circuit 20 and the type I amplitude matrix 22. The layout control unit 28 comprises gain adjustment devices 29 and 30 arranged to apply gain $$\sqrt{2} \sin \theta$$

to the X signal and gain $$\sqrt{2} \cos \theta$$

to the Y signal respectively to provide inputs W′, X′ and Y′ to the amplitude matrix 22.

One form of layout control unit 28 is shown in FIG. 6. The gain control units 29 and 30 comprise respective inverting amplifiers 32 and 34, each of which has a feedback resistor R, an input resistor S and an output resistor T. The outputs X′ and Y′ of the gain control units 29 and 30 are also interconnected by a potentiometer U. The resistance R may have any convenient value and the resistance U may have any convenient value such that $$U < \sqrt{2}L$$

where L is the input impedence of the amplitude matrix 22 for all input signals. Then, if $$T = UL/\ \sqrt{2}\,L\text{-}U$$

and $$S = \frac{\sqrt{2}\,L - U}{\left(2 + \sqrt{2}\right) L}$$

the gains for the X and Y signals are a good approximation to $$\sqrt{2} \sin \theta$$

and $$\sqrt{2} \cos \theta$$

respectively when $\theta$ is in the range 0° to 90°. In practice, it is preferable to keep $\theta$ within the range of about 25° to 65° since, outside this range, the angle subtended at the listening position by two of the pairs of adjacent loudspeakers become inconveniently large. This range may be limited by connecting fixed resistors in series with the potentiometer U and reducing the resistance of the potentiometer so that the overall resistance remains the same.

The W input signal to the layout control unit 25 is also connected to the W′ output thereof by an inverting amplifier 35 having feedback and input resistors of equal value R, thus matching the phase inversion introduced to the X and Y signals by the variable gain circuits.

It should be appreciated that changing the relative amplitudes of the X and Y signals has exactly the same effect as changing the phase of the phasor signal $P_1$ relative to the omni-directional signal $W_1$.

The above gains of $2 \sin \theta$ in the X signal path and $2 \cos \theta$ in the Y signal path are first order approximations to ideal gains. Better approximations are obtained if the gains are of the form $\sqrt{2}\, k \sin \theta$ and $\sqrt{2}\, k \cos \theta$ respectively. At frequencies below about 500 Hz, the preferred form of k is given by $$K = \frac{1}{\sin 2\,\Theta} = \frac{1}{2 \sin \Theta \cos \Theta}$$

which is approximately equal to 1 where $\theta$ equals 45°. At higher frequencies, the preferred value is $k = 1$. If, as described above, these gains are not frequency dependent, the choice of $k = 1$, as described above, is satisfactory at all frequencies.

Similar techniques may be used in conjunction with a WXYZ decoder for an eight loudspeaker cuboid array. In order to provide a decoder for the array shown in FIG. 7, the decoder shown in FIG. 3 is modified as shown in FIG. 8 by inserting a layout control unit 36 comprising gain adjustment devices 38, 40 and 42 for the X, Y and Z channels respectively, between the WXYZ circuit 24 and the type II amplitude matrix 26. The approximate optimal gains for frequencies above and below 500 Hz are shown in the Table I.

Table I

| channel | high frequency gain | low frequency gain |
|---|---|---|
| X | $\frac{\sqrt{3}\,ac}{\sqrt{a^2b^2+b^2c^2+c^2a^2}}$ | $\frac{\sqrt{a^2+b^2+c^2}}{\sqrt{3}\,b}$ |
| Y | $\frac{\sqrt{3}\,bc}{\sqrt{a^2b^2+b^2c^2+c^2a^2}}$ | $\frac{\sqrt{a^2+b^2+c^2}}{\sqrt{3}\,a}$ |
| Z | $\frac{\sqrt{3}\,ab}{\sqrt{a^2b^2+b^2c^2+c^2a^2}}$ | $\frac{\sqrt{a^2+b^2+c^2}}{\sqrt{3}\,c}$ |

As for the rectangular decoder, if the gains are to be frequency independent, the values shown for high frequencies may be used. These values are equivalent to the values shown in Table II.

Table II

| channel | gain |
|---|---|
| X | $\sqrt{3} \sin \Theta$ |
| Y | $\sqrt{\frac{3}{2}} \cos \Theta \,.\, \sqrt{2} \sin \phi$ |

Table II-continued

| channel | gain |
|---|---|
| Z | $\sqrt{\frac{3}{2}} \cos \Theta \,.\, \sqrt{2} \cos \phi$ |

where $$b : a : c = \frac{1}{\sin \Theta} : \frac{1}{\cos \Theta \sin \phi} : \frac{1}{\cos \Theta \cos \phi}$$

The gain adjustment devices 38, 40 and 42 may be implemental in a similar manner to the gain adjustment devices 29 and 30 of FIG. 6, the gain adjustment devices 40 and 42 each comprising two stages in cascade, one with gain $$\sqrt{\frac{3}{2}} \cos \Theta$$

and the other with gain $\sqrt{2} \sin \theta$ for the device 40 and $\sqrt{2} \cos \theta$ for the device 42.

The three input signals to the WXYZ circuit 24 of FIG. 8 may consist of linear combinations of the signals $W_4$, $Y_4$ and $V_4$ where $W_4$ is an omni-directional signal that picks up all sound directions with identical gain, $Y_4$ is a signal resulting from picking up a sound with gain $\sqrt{3}$ y and $V_4$ is a signal resulting from picking up a sound with directional gain $\sqrt{3}\,(-qjz)$, where $q$ is a real constant, and $(x, y, z)$ are the sound directions. Then the outputs of the WXYZ circuit 24 are related to its inputs as follows:

$$W = W_4$$

$$X = fV_4$$

$$Y = fY_4$$

$$Z = fjq^{-1}V_4$$

where $f$ is a real constant. Ideally at low frequencies $f = 1$; ideally at mid-high frequencies, $$f = \frac{1}{\sqrt{3(1+q^{-2})}}$$

It is clear that by interchanging axes, other encoding systems may be obtained. For example, one might consider the signals with directional gains $1, x - jqy, z$ or $1, x, y - jqz$. The corresponding decoders are obtained by exchanging the signal paths accordingly.

The decoders described above do not make special provision for the different mechanisms by which the human ears localise sounds above and below about 700 Hz. Decoders which do take into account these differences employ frequency dependent matrices approximating to an "ideal" low frequency design at low frequencies and an "ideal" high frequency design at high frequencies. There is also a transition region of frequencies in which the decoder matrix has an intermediate form. Theoretically, the centre of this transition region should be about 700 Hz. It has been found that, in practice satisfactory results can be obtained if the centre of this transition region is within the range of 100 Hz to 1000 Hz but that good listening conditions away from the centre of the listening area are best obtained if the centre of this region is below 700 Hz and a value of 320 Hz has been found to be particularly suitable.

It has been found that there are four localisation criteria. Two of these criteria relate to voltage gain and are dominant at low frequencies. The other two criteria relate to the energy gain to which the signal is subject and are dominant at high frequencies. The symbols $LB_V$, $LF_V$, $RF_V$ and $RB_V$ represent the complex voltage gains that a monophonic sound in some direction is subjected to when passed through the entire system, i.e., the original encoder and the decoder to feed the four loudspeakers shown in FIG. 1. Then, for a sound for which the desired apparent azimuth angle is $\phi$, the more important low frequency condition, known as the Makita condition, that the quantities $x$ and $y$ given by $$x = Re\left(\frac{LF_V + RF_V - LB_V - RB_V}{LF_V + RF_V + LB_V + RB_V}\right)$$

$$y = Re\left(\frac{LF_V + LB_V - RF_V - RB_V}{LF_V + RF_V + LB_V + RB_V}\right)$$

must be expressible in the form $$x \cos\theta = r \cos\phi$$

$$y \sin\theta = r \sin\phi$$

where r is a positive number. The symbol "Re" means "the real part of". If this condition is satisfied, the correct apparent direction of the sound is obtained at low frequencies. However, unless a second condition, known as the velocity condition is also satisfied, the apparent direction of the sound tends to be unstable when the listener moves his head. The velocity condition is $$(x \cos\theta)^2 + (y \sin\theta)^2 = 1$$

At higher frequencies, above the transition frequency, the most important conditions is the so-called energy vector condition that the quantities $x_E$ and $y_E$ given by $$x_E = \frac{|LF_V|^2 + |RF_V|^2 - |LB_V|^2 - |RB_V|^2}{|LF_V|^2 + |RF_V|^2 + |LB_V|^2 - |RB_V|^2}$$

$$y_E = \frac{|LF_V|^2 + |LB_V|^2 - |RF_V|^2 - |RB_V|^2}{|LF_V|^2 + |RF_V|^2 + |LB_V|^2 + |RB_V|^2}$$

must be expressible in the form $$x_E \cos\theta = r_E \cos\phi$$

$$y_E \sin\theta = r_E \sin\phi$$

where $r_E$ is a positive number. This determines correct localisation but, if the apparent direction of sound at higher frequencies is to be stable when the listener moves his head, it is in addition necessary, in accordance with the energy magnitude condition for the quantity $$(x_E \cos\theta)^2 + (y_E \sin\theta)^2$$

to be as large as possible for all directions. In practice, it may be necessary to sacrifice the magnitude of this quantity for some directions in order to improve it in others. The quantity can, of course, never exceed 1.

The Makita condition and the energy vector condition, which determine the basic sound directions at low and high frequencies respectively, are the most important. Since it is not clear precisely which of these theories is more important in the region of frequencies around the transition frequencies, it is important that both conditions are satisfied in this region. It can be shown mathematically that any WXY decoder or WXYZ decoder which satisfies either the Makita condition or the energy vector condition automatically satisfies both conditions. Thus, a WXY decoder or a WXYZ decoder designed to satisfy, for example, the Makita condition at all frequencies will give correct sound localisation at all frequencies. This applies to the decoders described above. In order to improve the stability of apparent sound direction as a listener's head moves, it is necessary to satisfy the velocity condition at lower frequencies and the energy magnitude condition at higher frequencies. This involves the use of frequency dependent decoders.

FIG. 9 shows a decoder similar to that shown in FIG. 5 but modified to provide the required frequency dependence. Two identical shelf filters 44 and 46, of the type I are connected in the X and Y signal paths respectively. A shelf filter 48 of type II is connected in the W signal path. The shelf filters 44, 46 and 48 are filters with substantially identical phase responses and each having one gain at low frequencies, below a transition frequency, another gain at high frequencies above such transition frequency and which smoothly make the transition from low frequency gain to the high frequency gain across a frequency band around the transition frequency. When, as shown, the input to the decoder takes the form of an omni-directional signal $W_1$ and a phasor signal $P_1$, the relative gains of all the shelf filters, 44, 46 and 48 are 1 at frequencies above the transition frequency band in order to give optimum high frequency reproduction according to the energy magnitude condition. At frequencies below the transition frequency band, the gains of the shelf filters I relative to that of the shelf filter II are $$2/\sin 2\theta$$

which is approximately equal to 2 when $\theta$ is in the range 30° to 60°. Consequently, it is satisfactory if the type I shelf filters have twice the gain of the type II shelf filter at frequencies below the transition frequency band.

A particular decoder circuit of this type is illustrated in FIG. 10. In order to reduce the number of components required, the shelf filters and layout control are located before a modified WXY circuit 50. This means that a single type I shelf filter 52 is connected in the phasor signal path in place of the two type I shelf filters 44 and 46 in the X and Y signal paths respectively. The layout control unit 20 provides two phasor inputs to the WXY circuit 50 which comprises two 0° phase shift circuits 54 and 56 and one 90° phase shift circuit 58.

The shelf filter 48 is required to have a complex frequency response given by:

$$\frac{\sqrt{a_1 b_1}\left(\sqrt{\frac{a_1}{b_1}}+j\omega T_1\right)}{1+j\sqrt{\frac{a_1}{b_1}}\ (\omega T_1)}\times\frac{1-j\omega T_2}{1+j\omega T_2}$$

where $a_1$ is the low frequency gain and $b_1$ is the high frequency gain. This filter consists of an amplifier 60 connected to a capacitance resistance network comprising resistances $R_1$, $R_2$ and $R_3$ and capacitance $C_1$. In turn, this is connected to a parallel circuit having amplifier 62 and capacitor $C_2$ in one branch and amplifier 64 and resistance $R_4$ in the other branch. For a transition frequency of 200 Hz, the variables in the expression for frequency response and the circuit components have the values indicated in Table III.

Table III

| | |
|---|---|
| $a_1$ | 0.6325 |
| $b_1$ | 1 |
| $T_1$ | 946.3$\mu$ secs. |
| $T_2$ | 838.8$\mu$ secs. |
| gain of 60 | 1.2649 |
| gain of 62 | −1 |
| gain of 64 | 1 |
| $R_1$ | 0.1325 $R_o$ |
| $R_2$ | 0.3675 $R_o$ |
| $R_3$ | 0.5 $R_o$ |
| $R_o C_1$ | 3237$\mu$ secs. |
| $R_4 C_2$ | $T_2$ |

The values of $R_0$ and $R_4$ are chosen arbitrarily according to design convenience.

The shelf filter 52 for the phasor signal P has the following complex frequency response:

$$\frac{\sqrt{a_3 b_3}\left(\sqrt{\frac{a_3}{b_3}}-j\omega T_3\right)}{1+j\sqrt{\frac{a_3}{b_3}}\ \omega T_3}$$

where $a_3$ is the low frequency gain and $b_3$ is the high frequency gain. This filter consists of two parallel paths, one consisting of an amplifier 66 and a resistor $R_5$ and the other consisting of an amplifier 68 and a capacitor $C_3$. The values of the various circuit components are shown in Table IV.

Table IV

| | |
|---|---|
| $a_3$ | $a_1$ |
| $b_3$ | $b_1$ |
| $T_3$ | 669.2$\mu$ secs. |
| gain of 54 | 1.2649 |
| gain of 56 | −1 |
| $R_5 C_3$ | 752.6$\mu$ secs. |

The value of the resistance $R_5$ is chosen arbitrarily according to design convenience.

The layout control unit 28 consists of an amplifier 70 of gain 1.707, two fixed resistances 72 and 74 in series with the outputs to the two phase shift circuits 56 and 58 in WXY circuit 50 and a chain formed by fixed resistances 76 and 78 and a potentiometer 80 connected in parallel with the two outputs of the network. The moving contact of the potentiometer 80 is connected to earth. The two resistances 76 and 78 in series with the potentiometer each have resistance values equal to half that of the potentiometer 80. The two series resistances 72 and 74 each have resistance value equal to 1.414 times the resistance of the potentiometer 80. The amplifier 60 ensures that the sum of the energies at the two outputs of the layout control unit 28 is effectively equal to the energy at the input thereof.

The circuit shown in FIG. 10 also includes a high pass filter 82 in the input path for the signals $P_1$. The high pass filter 82 consists of a capacitor 84 and a potentiometer 86. The purpose of this filter is to compensate for the effect at the listening position due to the distance between the loudspeakers and a central listener. The effect of a finite loudspeaker distance is to produce a bass boost and phase shift in the low frequency components of the velocity of the sound field at the listener and this, in turn, can degrade the image quality and may in some circumstances cause errors in the location of sound images at both frequencies.

In use, the setting of the potentiometer 86 is adjusted so that the time constant of the filter is equal to the time taken for sound to travel from any of the loudspeakers 11 to 14 to the centre point 10 of the listening area (FIG. 1). The potentiometer 86 preferably has an associated scale calibrated in distance to facilitate this setting.

It should be noted that, as illustrated in FIG. 1, the loudspeakers 11 to 14 are preferably equidistant from the centre point 10. If it is necessary for the distances of the various loudspeakers from the centre point 10 to differ from one another, the amplitude gains of the signals for the more distant loudspeakers are increased until a subjectively satisfactory result is obtained.

Similar compensation for the different localisation mechanisms used by the human ear at low and high frequencies may be applied to WXYZ decoders, respective type I shelf filters being connected in the X, Y and Z channels and a type II shelf filter in the W channel. Where the input signal is a four channel signal consisting of four linear combinations of an omnidirectional signal and three signals resulting from picking up sound from an arrival direction given by direction cosines $(x, y, z)$ with respective directional gains $\sqrt{3}\,x$, $\sqrt{3}\,y$ and $\sqrt{3}\,z$, the low and high frequency gains of these shelf filters are as follows:

| Filter | Low frequency gain | High frequency gain |
|---|---|---|
| I | 1 | $\sqrt{\frac{2}{3}}$ |
| II | 1 | $\sqrt{2}$ |

FIG. 11 illustrates a decoder in accordance with the invention for use with so-called "discrete" or "pairwise mixed" four channel signals. Such four channel signals assign sounds to a horizontal direction between the azimuths of two adjacent loudspeakers of a square layout by feeding them to both channels corresponding to adjacent speakers with the same phase but differing intensities thus, there are four input channels $LB_1$, $LF_1$, $RF_1$ and $RB_1$. For an azumith $\phi$ from the front direction, the gains of the signals in the four input channels are shown in Table V.

Table V

| | $-45° \leq \phi \leq 45°$ | $45° \leq \phi \leq 135°$ | $135° \leq \phi \leq 225°$ | $-135° \leq \phi \leq -45°$ |
|---|---|---|---|---|
| $LB_1$ | 0 | $\cos(135°-\phi)$ | $\sin(225°-\phi)$ | 0 |
| $LF_1$ | $\cos(45°-\phi)$ | $\sin(135°-\phi)$ | 0 | 0 |
| $RF_1$ | $\sin(45°-\phi)$ | 0 | 0 | $\cos(-45°-\phi)$ |
| $RB_1$ | 0 | 0 | $\cos(225°-\phi)$ | $\sin(-45°-\phi)$ |

Such an encoding specification is in common use. It may be decoded using a WXY decoder as shown in FIG. 13. The WXY circuit 88 thereof comprises a type III amplitude matrix 90 in the form $$X_2 = \tfrac{1}{2}(-LB_1+LF_1+RF_1-RB_1)$$

$$Y_2 = \tfrac{1}{2}(LB_1+LF_1-RF_1-RB_1)$$

$$W_2 = \tfrac{1}{2}(LB_1+LF_1+RF_1+RB_1)$$

$$F = \tfrac{1}{2}(-LB_1+LF_1-RF_1+RB_1)$$

The difference outputs $X_2$ and $Y_2$ of the amplitude matrix 90 are connected via respective 0° phase shift circuits 92 and 94 to provide the X and Y outputs. The omni-directional output $W_2$ is connected via a 0° phase shift circuit 96 and the diagonal difference output F via a 90° phase shift circuit 98 to a proportional adder 100 which applies gain 0.707 to the $W_2$ input, gain 0.455 to the *j*F input and then sums these two signals to provide W output. The X and Y signals are applied to type I shelf filters 102 and 104 similar to the shelf filter 52 shown in FIG. 12 but having unity gain at low frequencies and $\sqrt{3/4}$ gain at high frequencies. The W signal is applied to a type II shelf filter 106 which is similar to the shelf filter 48 of FIG. 10 but having unity gain at low frequencies and $\sqrt{3/2}$ gain at high frequencies. The outputs of the shelf filters 102 and 104 are connected to variable high pass filters 108 and 110 which are identical with the high pass filer 82 of FIG. 10 and have the control of their potentiometers ganged. These filters 108 and 110 provide compensation for loudspeaker proximity as described with reference to FIG. 10. The outputs of the filters 108 and 110 are then connected to a layout control unit 112. The layout control unit 112 comprises a pair of input amplifiers 114 and 116, each having gain 2.414 and having their outputs connected to the outputs of the layout control unit by equal resistors 118 and 120. A resistance chain, consisting of resistor 122, potentiometer 124 and resistor 126 is connected between the outputs of the distance control unit. The relationship between the resistance values of the potentiometer 124 and the various resistors is as stated in Table VI where S may have any convenient value.

Table VI

| Component | Resistance |
|---|---|
| 118 | 0.707 S |
| 120 | 0.707 S |
| 122 | 0.25 S |
| 124 | 0.50 S |
| 126 | 0.25 S |

The use of the resistors 122 and 126 in series with the potentiometer 112 limits the range of adjustment of the layout control to that over which satisfactory results can be achieved as described above with reference to FIG. 6.

The decoder illustrated in FIG. 11 may also be used as a four loudspeaker decoder for conventional stereo recordings by connecting the two stereo channels L and R to the inputs $LF_1$ and $RF_1$ respectively and grounding the other two inputs $LB_1$ and $RB_1$. Such stereo material is thus treated as four channel pairwise mixed material for which all sounds originate in the quadrant −45° to +45°.

A decoder in accordance with the invention may be used to decode signals from the TMX three channel system in which the input system to the decoders consists of three channels as follows:

$$L = \tfrac{1}{2}(W_3 + jP_3)$$

$$R = \tfrac{1}{2}(W_3 - jP_3)$$

$$T_T = jP_3^*$$

where $P_3^*$ is a signal whose azimuthal gain is the complex conjugate of that of $P_3$, as described in D. H. Cooper, T. Shiga and T Takagi "QMX Carrier Channel Disc" Journal of the Audio Engineering Society, Volume 21, Pages 614 to 624, October, 1973. The WXY circuit 88 of FIG. 11 is replaced by a WXY circuit as shown in FIG. 12. The L and R input signals are connected to a type IV matrix 110 of the form:

$$W_3 = L + R$$

$$jP_3 = L - R$$

The $W_3$ output of the matrix 130 is connected via a 0° phase shift circuit 132 to form the W output of the WXY circuit. The $jP_3$ output of the matrix 130 is connected both to 0° phase shift 134 and to a −90° phase shift circuit 136. Similarly, the $T_T$ input signal from the TMX source is connected both to a −90° phase shift circuit 138 and a −180° circuit 140. The outputs of the two −90° phase shift circuits 136 and 138 are added together, each with gain 0.707 in a proportional adder 142, the output of which forms the X output of the WXY circuit. Similarly, the outputs of the 0° phase shift 134 and the −180° phase shift 140 are added together, both with gains 0.707 in a proportional adder 144, the output of which forms the Y output of the WXY circuit.

A decoder in accordance with the invention can also be used for the QMX system as described in D. H. Cooper, T. Shiga and T. Takagi, "QMX Carrier Channel Disc". The QMX disc system incorporates TMX signals in which the $T_T$ signal is of restricted band width and is therefore not available above about 6 kHz. In a decoder for this system, the WXY circuit shown in FIG. 12 is replaced by a WXY circuit as shown in FIG. 13. It will be seen that this circuit differs fromm the circuit of FIG. 12 in that the W and jP outputs of the type IV matrix 130 are passed through an all-pass filter 146 and a type III shelf filter 148 and the $T_T$ input is passed through a low pass filter 150 with a cut-off frequency of about 2 kHz. The all-pass filter 146, the shelf filter 148 and the low pass filter 150 all have substantially the same phase response and all have unity gain at well below 2 kHz. The shelf filter 148 has gain $\sqrt{2}$ at high frequencies and a transition frequency equal to the −6 dB frequency of the low pass filter 150.

The low pass filter 150 comprises two identical resistor-capacitor low pass filters in cascade, the allpass filter 146 is a resistor-capacitor all-pass filter of the same time constant as the low pass filter 150 and the shelf filter 148 is a resistor-capacitor shelf filter followed by a phase-compensating all-pass filter of a similar design to those used for the type II shelf filter 48 in FIG. 10.

In the case of two-input WXY circuits, the input signals need not be the actual omni-directional input signal $W_1$ and the phasor input signal $P_1$. Any non-singular linear combination thereof may be used with a suitably modified WXY circuit. The signals Q and R which are related to the signals W and P as follows:

$$Q = \alpha W_1 + \beta P_1$$

$$R = \beta W_1 + \alpha P_1$$

where $\alpha$ and $\beta$ are complex numbers and $\alpha^*$ and $\beta^*$ their respective complex conjugates, may be used instead of the signals $W_1$ and $P_1$. This is because any such signals have equal amplitude but differing phase.

A decoder in accordance with the invention may also be used to decode inputs which may be regarded as consisting of two signals $W_4$ and $P_4$. $W_4$ is an omnidirectional signal with unit gain in all directions and $P_4$ is a signal with gain $m \cos \phi - j \sin \phi$ where $\phi$ is the azimuth angle from the front and $m$ is real. When $m = 1$, the signal $P_4$ is, of course, a conventional phasor signal. Inputs in the form of signals $W_4$ and $P_4$ can be decoded by a WXY circuit in accordance with the following equations:

$$W = W_4$$

$$X = \frac{1}{m\sqrt{2}} P_4$$

$$Y = \frac{1}{\sqrt{2}} jP_4$$

The encoding systems known as "BBC matrix G" and "BBC matrix H", described in British Broadcasting Corporation Research Department, Engineering Division Report BBC RD 1974 — 29, "The subjective Performance of Various Quadraphonic Matrix Systems" November, 1974, produce signals L and R corresponding to the stereo "left" and "right" signals. It can be shown that the signals L and R may be regarded as linear combinations of the signals $W_4$ and $P_4$ as follows:

$$W_4 = \gamma L + \gamma R$$

$$P_4 = \delta L + \delta R$$

where $\gamma$ and $\delta$ are non-zero complex numbers of modulus 1 and $\gamma^*$ and $\delta^*$ are their complex conjugates. The signals $W_4$ and $P_4$ can then be decoded by the above-described WXY circuit with m approximately equal to 0.68.

In all the embodiments of the invention described above, the signals W′, X′ and Y′ or W′, X′, Y′ and Z′ have been produced as discrete signals and aplied to either a type I or a type II amplitude matrix respectively. It should be understood that the invention is also applicable to systems in which these signals do not have a separate discrete existance but take the form of linear combinations of one another, the output signals to the loudspeakers being produced directly from such linear combinations.

Where it is possible to interchange the positions of circuits or to combine circuits without changing the overall function, such modifications are within the scope of the invention. For example, if two successive circuits can be expressed mathematically as respective matrices, then they be be replaced by a single circuit which can be represented mathematically by the product of the two matrices.

It should also be understood that, at any point in the systems described, additonal amplifiers may be inserted to provide such overall gain as is considered necessary or desirable by one skilled in that art. In particular, the outputs to the various loudspeakers will usually be connected to their respective loudspeakers via power amplifiers.

In all embodiments of the invention, there may be additional direct signal paths between the WXY circuit or the WXYZ circuit and the amplitude matrix providing the loudspeaker signals. For example, in the FIG. 9 embodiment, a fourth signal path F may be added directly connecting the WXY circuit 20 to the amplitude matrix 28 which is then arranged to produce output signals as follows:

$$LB = \tfrac{1}{2}(-X' + W' + Y' - F)$$

$$LF = \tfrac{1}{2}(X' + W' + Y' + F)$$

$$RF = \tfrac{1}{2}(X' + W' - Y' - F)$$

$$RB = \tfrac{1}{2}(-X' + W' - Y' + F)$$

which is as before if the F signal is 0. The addition of the F signal path will not affect the overall directional effect of the decoder provided that F is ± 90° out of phase with respect to X′ and Y′ for all directions.

What is claimed is:

1. A decoder for a sound reproduction system having four loudspeakers surrounding a listening area each located on one of the diagonals of a non-square rectangle between the point of intersection of said diagonals and a respective corner of said rectangle, said decoder comprising input means for receiving at least two input signals comprising omni-directional and phasor signal components and signal processing means for producing first and second difference signal components from said phasor signal components, said first difference signal components being dependent on the required difference in signal strength between the sum of the signals for a first adjacent pair of said loudspeakers and the sum of the signals for a second adjacent pair comprising the other two loudspeakers and said second difference signal components being dependent on the required difference in signal strength between the sum of the signals for a third adjacent pair of loudspeakers comprising one loudspeaker from each of said first and second adjacent pairs and the sum of the signals for a fourth adjacent pair of loudspeakers comprising the other loudspeaker from each of said first and second adjacent pairs of loudspeakers, said decoder further comprising layout control means for applying first and second gains to said first and second difference signal components, the ratio between the first and second gains being substantially equal to the ratio between the sine of half the angle between the diagonals on which said first pair of loudspeakers are located and the sine of half the angle between the diagonals on which said third pair of loudspeakers are located, and output means responsive to said layout control means and said omni-directional signal components for producing a responsive output signal for each loudspeaker.

2. A decoder as claimed in claim 1, in which said output means comprises an amplitude matrix.

3. A decoder as claimed in claim 1, in which said layout control means comprises means for producing a signal at a first output consisting of said first difference signal components, means for producing a signal at a second output consisting of said second difference signal components, and a resistance having an earthed intermediate tapping connected between said first and said second outputs, whereby the ratio of the resistance between the intermediate tapping and the first output to the resistance between the intermediate tapping and the second output determines the ratio between the first and second gains.

4. A decoder as claimed in claim 1, in which the input means comprises means for producing from said input signals, an omni-directional signal, a first difference signal and a second difference signal.

5. A decoder as claimed in claim 4, in which the input means comprises an amplitude matrix responsive to four-channel pairwise mixed input signals to produce the omni-directional signal, the first and second difference signals and a diagonal difference signal and means for aplying a 90° phase shift to said diagonal difference signal and adding said phase shifted diagonal difference signal to said omni-directional signal.

6. A decoder as claimed in claim 4, in which the input means comprises an amplitude matrix responsive to first and second input signals each of which comprises an omni-directional signal component and a phasor signal component, said amplitude matrix being arranged to produce an omni-directional output and a phasor output, said input means also having a third input for receiving a signal comprising the complex conjugate of the phasor signal component, means for subtracting the third input signal from the phasor output of the matrix to form said first difference signal and phase shift means for applying respective 90° phase shifts to the phasor output of the matrix and the third input signal and means for adding said phase shifted signals to form said second difference signal.

7. A decoder as claimed in claim 6, in which the third input is connected to its phase shift means via a low pass filter and the phasor output of the matrix is connected to its phase shift means and the subtraction means via a shelf filter having a transition frequency substantially equal to the cut off frequency of the low pass filter and a higher gain above the transition frequency than below the transition frequency.

8. A decoder as claimed in claim 1, in which the input means is arranged to supply a phasor signal to the layout control means, said layout control means being arranged to apply a first gain to the phasor signal to produce a first output comprising said first difference signal component and to apply a second gain to said phasor signal to produce a second output and means for applying a 90° phase shift to said second output to produce a signal comprising said second difference signal components.

9. A decoder as claimed in claim 1, for a sound reproduction system having eight loudspeakers located at the corner of a non-cubic cuboid, said input means being arranged to receive at least three input signals and said output means being arranged to produce a respective output signal for each loudspeaker, said first difference signal components indicating the difference in signal strength between the sum of the signals for the four loudspeakers at the corners of a first face of the cuboid and the sum of the signals for the four loudspeakers at the face of the cuboid opposite said first face and said second difference signal components indicating the difference in signal strength between the sum of the signals for the four loudspeakers at the corners of a second face of the cuboid perpendicular to said first face and the sum of the signals for the four loudspeakers at the corners of the face of the cuboid opposite said second face, said output signals also comprising third distance signal components indicating the difference in signal strength between the sum of the signals for the loudspeakers at the corners of a third face of the cuboid perpendicular both to said first face and to said second face and the sum of the signals for the four loudspeakers at the face of the cuboid opposite said third face, and said layout control means being arranged to apply a third gain to said third difference signal component, the ratio between the first, second and third gains being inversely proportional to the ratio between the distances separating said first, second and third faces of the cuboid from their respective opposite faces.

10. A decoder as claimed i claim 1, in which said phasor signal components are passed through high pass filter means having means for varying the time constant thereof whereby said time constant is adjusted to be equal to the time of travel of sound from the loudspeakers to the centre of the listening area.

11. A decoder for a sound reproduction system comprising output means for providing output signals for at least three loudspeakers surrounding a listening position, input means for receiving at least two input signals comprising pressure signal components representative of the sum of the desired output signals and velocity signal components representative of the desired velocity of the sound field at said listening position and gain adjustment means between the input means and the output means and arranged to apply frequency dependent relative gains to said pressure and velocity signal components such that the gain applied to pressure signal components of frequencies substantially above a predetermined frequency divided by the gain applied to velocity signal components of frequency substantially above said predetermined frequency is greater than the gain applied to pressure signal components of frequency substantially below said predetermined frequency divided by the gain applied to velocity signal components of frequencies substantially below said predetermined frequency.

12. A decoder as claimed in claim 11, in which said input means is arranged to provide a discrete signal containing only pressure signal components and a discrete signal containing only velocity signal components and said gain adjustment means comprises a shelf filter having a first characteristic responsive to the velocity signal and a shelf filter having a second characteristic responsive to the pressure signal.

13. A decoder as claimed in claim 12, in which the gain of the first type of shelf filter at frequencies substantially below the transition frequency is twice that of the second type of filter.

* * * * *